US008670916B2

(12) United States Patent
Maruyama

(10) Patent No.: US 8,670,916 B2
(45) Date of Patent: Mar. 11, 2014

(54) FUEL INJECTION SYSTEM FOR INTERNAL COMBUSTION ENGINE

(75) Inventor: Masatoshi Maruyama, Nagoya (JP)

(73) Assignee: Denso Corporation, Kariya (JP)

( * ) Notice: Subject to any disclaimer, the term of this patent is extended or adjusted under 35 U.S.C. 154(b) by 222 days.

(21) Appl. No.: 13/398,873

(22) Filed: Feb. 17, 2012

(65) Prior Publication Data

US 2012/0215421 A1 Aug. 23, 2012

(30) Foreign Application Priority Data

Feb. 18, 2011 (JP) ..... 2011-033538

(51) Int. Cl.
*F02M 37/02* (2006.01)
*F02M 37/06* (2006.01)

(52) U.S. Cl.
USPC ..... 701/104; 123/500

(58) Field of Classification Search
USPC ..... 701/101, 102, 104; 123/500–503, 123/510–512, 495, 456, 463
See application file for complete search history.

(56) References Cited

U.S. PATENT DOCUMENTS 5,058,553 A 10/1991 Kondo et al.
5,711,275 A * 1/1998 Minagawa et al. ..... 123/458
6,422,203 B1 * 7/2002 Djordjevic ..... 123/456
7,201,148 B2 4/2007 Nakane
2007/0017485 A1 1/2007 Nakane

FOREIGN PATENT DOCUMENTS

| | | |
|---|---|---|
| JP | 2-146256 | 6/1990 |
| JP | 3-18645 | 1/1991 |
| JP | 04-325750 | 11/1992 |
| JP | 2002-349328 | 12/2002 |
| JP | 2004-036491 | 2/2004 |
| JP | 2007-023930 | 2/2007 |
| JP | 2008-291670 | 12/2008 |

* cited by examiner

*Primary Examiner* — Mahmoud Gimie
(74) *Attorney, Agent, or Firm* — Nixon & Vanderhye PC

(57) ABSTRACT

A fuel injection system for an internal combustion engine is provided which works to correct the pressure of fuel, as measured by a pressure sensor, using a pressure change corresponding to a change in quantity of the fuel in a common rail within a pressure change compensating time Tp to determine a pump discharge pressure Ptop. This compensates for an error in determining the pump discharge pressure Ptop which arises from propagation of the pressure of fuel from a pump to the pressure sensor. The pressure change compensating time Tp is the sum of a time T1 elapsed between sampling the output of the pressure sensor before a calculation start time when the pump discharge pressure is to start to be calculated and the calculation start time and a time T2 required for the pressure to transmit from the outlet of the pump to the pressure sensor.

4 Claims, 4 Drawing Sheets

FUEL INJECTION SYSTEM FOR INTERNAL COMBUSTION ENGINE

CROSS REFERENCE TO RELATED DOCUMENT

The present application claims the benefit of priority of Japanese Patent Application No. 2011-33538 filed on Feb. 18, 2011, the disclosure of which is incorporated herein by reference.

BACKGROUND

1. Technical Field

The present invention relates generally to a fuel injection system for internal combustion engines, and particularly to a common rail fuel injection system for diesel engines which may be employed in automotive vehicles.

2. Background Art

Typical fuel injection systems for internal combustion engines need to control the amount of fuel discharged from a fuel feed pump finely to supply a required amount of fuel to the internal combustion engine. Specifically, the fuel injection systems determine a target amount of fuel (i.e., a target flow rate of fuel) to be supplied to the engine in the next cycle based on current operating conditions of the engine and control an operation of a fuel injector to achieve the target amount of fuel.

The quantity of fuel to be sprayed from the fuel injector usually depends greatly upon the pressure of fuel at an on-time when the fuel injector is opened. The fuel injection systems, therefore, regulate the amount of fuel to be discharged from the pump based on the operating conditions of the engine to bring the pressure of fuel into agreement with a target level. For instance, Japanese Patent First Publication No. 3-18645 teaches such a fuel injection system.

Generally, the operation of the pump of the fuel injection systems is controlled based on a discharged pressure of fuel (i.e., the pressure of fuel at an outlet of the pump). The fuel injection systems usually have a pressure sensor installed in a portion of a high-pressure fuel path which is closer to the fuel injector than to the outlet of the pump, which will lead to the high probability that the pressure of fuel, as measured by the pressure sensor is different from that of fuel discharged actually from the pump.

Specifically, the pressure of fuel at the outlet of the pump usually starts to rise at the moment the fuel is discharged from the pump, but it is impossible for the pressure sensor to measure such a pressure change until it propagates to the pressure sensor. Therefore, when the pressure of fuel discharged from the pump is changing momentarily, it almost results in a difference between the pressure of fuel, as measured by the pressure sensor, and that of fuel discharged actually from the pump.

The fine control of the quantity of fuel to be sprayed from the fuel injector, however, requires accurate measurement of the pressure of fuel in the fuel injector. The installation of the pressure sensor at the outlet of the pump will, therefore, result in an error in measuring the pressure of fuel due to the propagation of the pressure of fuel, as described above.

SUMMARY

It is therefore an object to provide a fuel injection system designed to accurately determine a pump discharge pressure that is the pressure at which fuel is discharged from a pump.

According to one aspect of the invention, there is provided a fuel injection system which may be employed with an internal combustion engine for automotive vehicles. The fuel injection system is configured to supply fuel to an internal combustion engine and includes: (a) a pump 3 which pressurizes and feeds fuel, as stored in a fuel tank 9, from an outlet thereof to a fuel path 4; (b) a fuel injector 6 which works to spray the fuel, as supplied from the fuel path 4, to an internal combustion engine 8; (c) a pressure sensor 10 installed in a portion of the fuel path 4 which is located closer to the fuel injector 6 than to the outlet of the pump 3, the pressure sensor 10 producing an output indicating a pressure of the fuel in the fuel path 4; and (d) a calculator 7 which samples the output of the pressure sensor 10 and calculates a pump discharge pressure that is a pressure at which the fuel is discharged from the pump 3 based on the pressure, as measured by the pressure sensor 10, to control an operation of the pump 3 based on the pump discharge pressure. The calculator 7 performs a pressure change compensating time calculation task, a quantity change calculation task, a conversion task, and a discharge pressure calculation task. The pressure change compensating time calculation task is to add a time T1 elapsed between sampling the output (i.e., the pressure Psens) of the pressure sensor 10 before a calculation start time when the pump discharge pressure is to start to be calculated and the calculation start time to a time T2 required for the pressure to transmit from the outlet of the pump 3 to the pressure sensor 10 to define a pressure change compensating time Tp. The quantity change calculation task is to calculate a quantity change $\Delta Q$ that is a change in quantity of the fuel staying in the fuel path 4 within the pressure change compensating time Tp. The conversion task is to convert the quantity change, as derived by the quantity change calculation task, into a pressure change $\Delta P$. The discharge pressure calculation task is to calculate the pump 3 discharge pressure based on the pressure change and the output of the pressure sensor 10.

Specifically, the calculator serves to correct the pressure of fuel, as measured by the pressure sensor, so as to compensate for an error in determining the pump discharge pressure which arises from the propagation of the pressure from the pump to the pressure sensor.

In the preferred mode of the embodiment, the quantity change calculation task may include a discharged quantity calculation task to calculate a quantity of the fuel discharged from the pump within the pressure change compensating time, an injection quantity calculation task to calculate a quantity of the fuel injected from the fuel injector into the internal combustion engine within the pressure change compensating time, and a drained quantity calculation task to calculate a quantity of the fuel drained from the fuel path to a lower-pressure side within the pressure change compensating time, thereby deriving the quantity change.

The pump may be designed to have a plunger which reciprocates to discharge the fuel cyclically and equipped with a flow rate control valve which works to control a quantity of fuel to be discharged from the pump in each cycle of reciprocating motion of the plunger. The fuel injection system also includes a controller which works to control an operation of the flow rate control valve based on the pump discharge pressure so as to bring the pressure of the fuel in the fuel path into agreement with a target value, as determined based on an operating condition of the internal combustion engine. When a value derived by dividing a time at least including an actuation time of the flow rate control valve by one cycle time that is a time required by the plunger to reciprocate is greater than or equal to a given value, the discharge pressure calculation task calculates the pump discharge pressure based on the pressure change and the output of the pressure sensor.

The pump discharge pressure may be determined directly and accurately based on the output of the pressure sensor, as sampled after a lapse of a period of time required (i.e., the propagation time T2) for the pressure to propagate from the outlet of the pump to the pressure sensor.

However, when the value derived by dividing the time including the actuation time of the flow rate control valve by the one cycle time (which will also be referred to as an operating time ratio) is great, and the controller starts to control the operation of the flow rate control valve after a lapse of the propagation time, it may cause the plunger to have already entered the subsequent cycle when the flow rate control valve has started to be actuated. In such an event, it is impossible to control the quantity or flow rate of fuel discharged from the pump accurately.

In order to alleviate the above problem, the controller calculates the pump discharge pressure based on the pressure change and the output of the pressure sensor (i.e., the pressure Psens) when the operating time ratio is greater than the given set value. This enables the operation of the flow rate control valve to start to regulate the flow rate of fuel discharged from the pump accurately prior to expiry of the propagation time.

When the pump or the fuel injector is operating properly, the output of the pressure sensor will not be excessively large, but when it has failed in operation, it may cause the output of the pressure sensor to have a value exceeding a normal set pressure. In contrast, the fuel injection system is so designed that when a pressure of the fuel, as measured by the pressure sensor at the calculation start time, is greater than or equal to a given set value, the controller defines the measured pressure as the pump discharge pressure to control the quantity of the fuel to be discharged from the pump, while when the pressure of the fuel, as measured by the pressure sensor at the calculation start time, is smaller than the given set value, the controller defines a pressure of the fuel, as determined based on the pressure change and the output of the pressure sensor as the pump discharge pressure to control the quantity of the fuel to be discharged from the pump. This results in improved reliability in operation of the fuel injection system.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings:

FIG. 1(*b*) is a block diagram which shows an electronic control unit of the fuel injection system of FIG. 1(*a*);

DESCRIPTION OF THE PREFERRED EMBODIMENTS

Figure 1B:
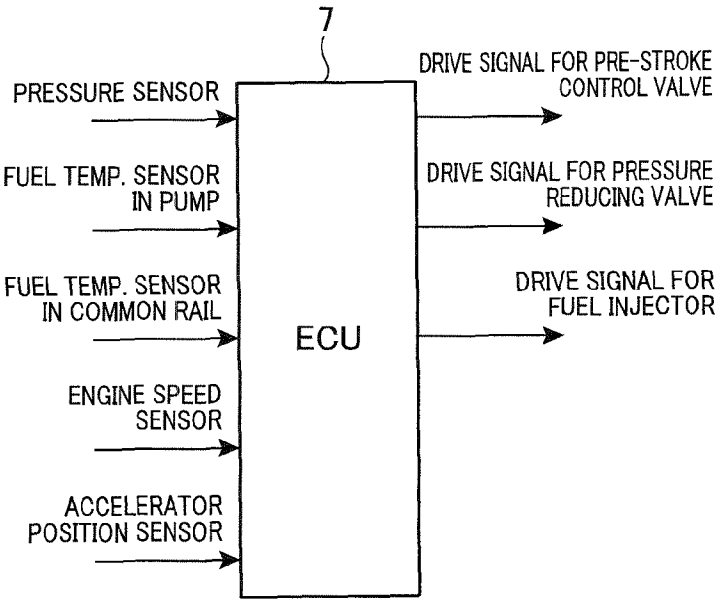
FIG. 1(*a*) is a block diagram which shows a fuel injection system according to an embodiment of the invention.
Figure 1A:
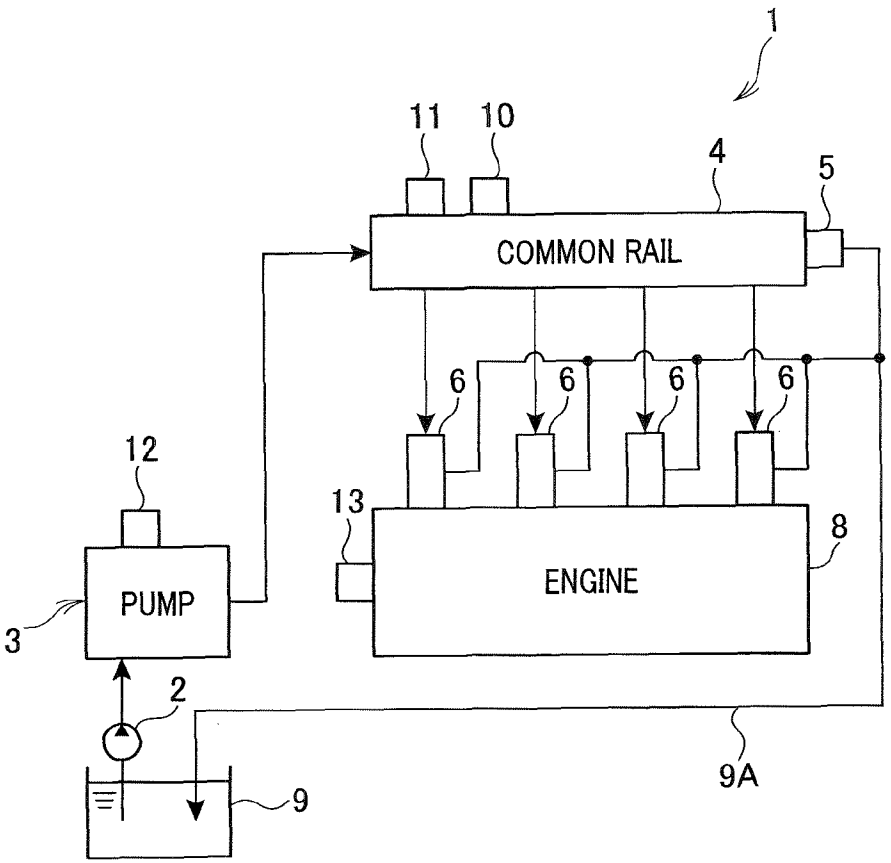

Referring to the drawings, wherein like reference numbers refer to like parts in several views, particularly to FIGS. 1(*a*) and 1(*b*), there is shown a fuel injection system 1 according to an embodiment of the invention which is designed to control spraying of fuel to an internal combustion diesel engine 8 for automotive vehicles.

1. Structure of Fuel Injection System

The fuel injection system 1 is of a common rail type and equipped with a feed pump 2, a high-pressure pump 3, a common rail 4 serving as a fuel accumulator, a pressure-reducing valve 5, fuel injectors 6, and an electronic control unit (ECU) 7 which drives the fuel injectors 6 (i.e., fuel injection valves) installed one in each of four cylinders #1 to #4 of the diesel engine 8.

The feed pump 2 sucks fuel from a fuel tank 9 and feeds it to the high-pressure pump 3. The high-pressure pump 3 is, as illustrated in FIG. 2, equipped with a plunger 3A which is driven by an output of the engine 8 so that it reciprocates in synchronization with rotation of the engine 8 to suck, pressurize, and discharge the fuel cyclically.

The plunger 3A is reciprocated by a triangular cam which rotates synchronously with rotation of a crankshaft of the engine 8. The plunger 3A reciprocates up and down every 360° rotation of the cam. Specifically, when an angular position of the cam is at 0° or an even multiple of 180° from the top dead center, the plunger 3A is at the top dead center. When the angular position of the cam is at an odd multiple of 180° from the top dead center, the plunger 3A is at the bottom dead center.

Figure 2:
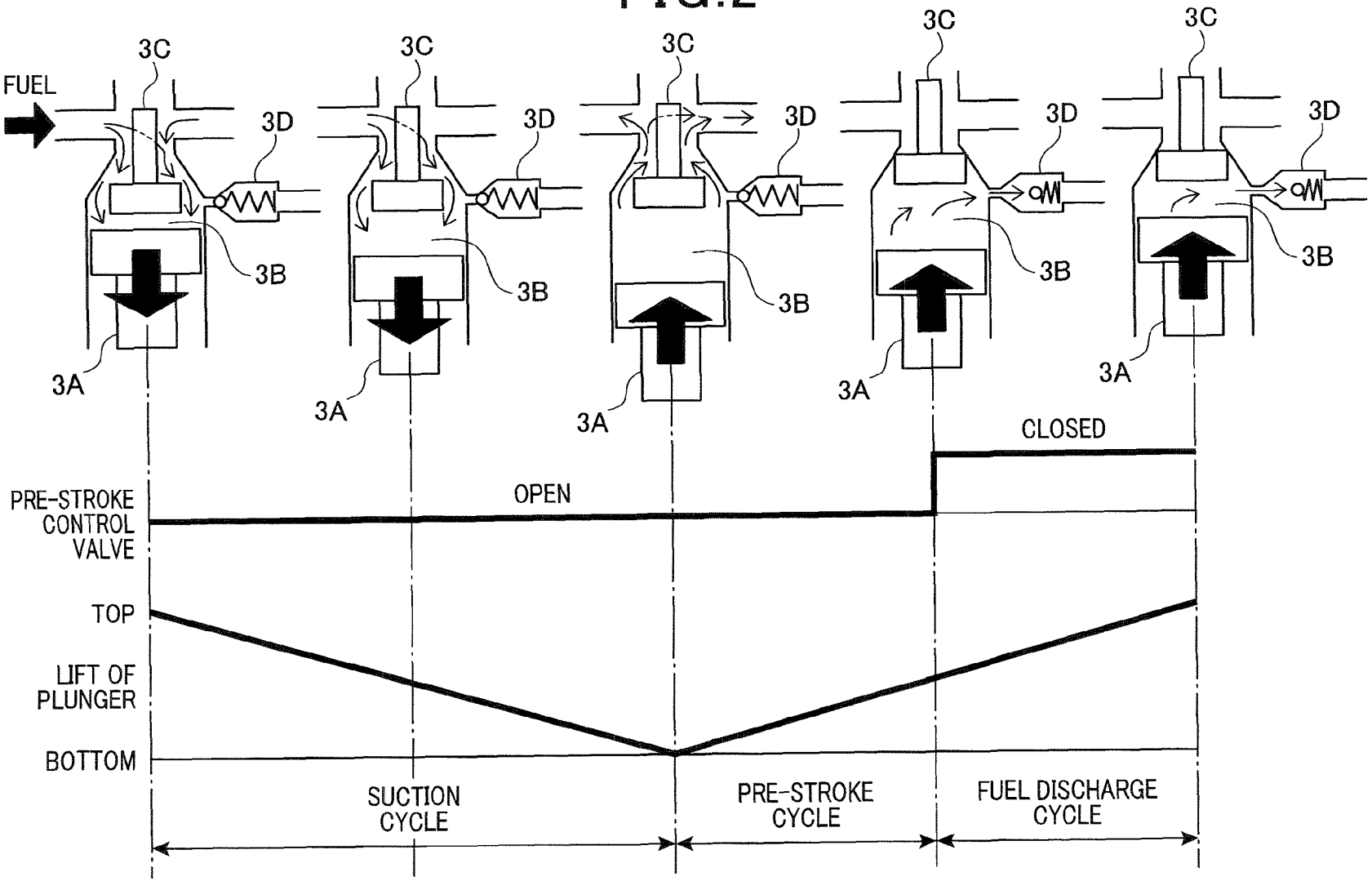
FIG. 2 is a schematic view which shows prestroke flow rate control in a high-pressure pump of the fuel injection system of FIG. 1(*a*)

The high-pressure pump 3 is, as illustrated in FIG. 2, also equipped with a pre-stroke control valve 3C which is installed in an inlet through which the fuel enters the high-pressure pump 3. The pre-stroke control valve 3C works as a flow rate control valve to control the amount of fuel sucked into a pressure chamber 3B. The opening or closing of the pre-stroke control valve 3C is controlled by the ECU 7. The high-pressure pump 3 is also equipped with a check valve 3D which is installed in the outlet thereof and allows the fuel to flow only out of the high-pressure pump 3.

When the plunger 3A moves from the top dead center to the bottom dead center with the pre-stroke control valve 3C opened, the volume of the pressure chamber 3B will increase, so that the fuel, as supplied from the feed pump 2, is sucked into the pressure chamber 3B (which will also be referred to as a suction cycle).

When the plunger 3A moves from the bottom dead center to the top dead center with the pre-stroke control valve 3C opened, the fuel, as sucked into the pressure chamber 3B, will flow backward to the fuel tank 9 through the pre-stroke control valve 3C (which will also be referred to as a prestroke cycle).

Subsequently, when the pre-stroke control valve 3C is closed, the pressure, as remaining in the pressure chamber 3B, will be pressurized. When the pressure in the pressure chamber 3B exceeds that in the common rail 4, the fuel in the pressure chamber 3B will be fed to the common rail 4 through the check valve 3D (which will be referred to as a fuel discharge cycle). The amount of fuel to be supplied from the high-pressure pump 3 to the common rail 4 is, therefore, determined by controlling the time when the pre-stroke control valve 3C is to be opened or closed.

The pre-stroke control valve 3C is implemented by a solenoid-operated valve, but may alternatively be designed to be driven by an actuator using a piezoelectric device.

The common rail 4, as illustrated in FIG. 1(*a*), constitutes a high-pressure fuel path leading to the outlet of the high-pressure pump 3 and also serves as an accumulator in which the fuel, as fed from the high-pressure pump 3, is retained at a pressure determined as a function of an operating condition of the engine 8. When opened, the pressure-reducing valve 5 drains the fuel from the common rail 4 to a low-pressure path 9A leading to the fuel tank 9 to reduce the pressure of fuel within the common rail 4.

The fuel injectors 6 are connected to the common rail 4 in parallel to each other and work as fuel injection valves to spray the fuel, as supplied from the common rail 4, to the cylinders of the engine 8, respectively. Each of the fuel injectors 6 is of a known solenoid-operated or piezo-driven type in which the pressure of fuel in a pressure chamber which urges a nozzle needle in a valve-closing direction to close a spray hole is controlled to spray a desired quantity of the fuel.

The pressure sensor 10 is installed in a portion of the common rail 4 which is closer to the fuel injectors 6 than to the outlet of the high-pressure pump 3 and measures the pressure of fuel in the common rail 4. The common rail 4 also has a fuel temperature sensor 11 which measures the temperature of fuel in the common rail 4. Similarly, the high-pressure pump 3 has a fuel temperature sensor 12 which measures the temperature of fuel within the pressure chamber 3B of the high-pressure pump 3.

The fuel injection system 1 also includes an engine speed sensor 13 which measures the speed of rotation of the crankshaft of the engine 8 and an accelerator position sensor (not shown) which measures the position of an accelerator pedal (i.e., a driver's effort on the accelerator pedal). Outputs of the sensors 10 to 13 and the accelerator position sensor are, as illustrated in FIG. 1(*b*), inputted to the ECU 7.

The sensors 10 to 13 and the accelerator position sensor continue to output the signals to the ECU 7. The ECU 7, however, samples them at a time interval selected by a given program.

The ECU 7 is implemented by a typical microcomputer equipped with a CPU, a ROM, a RAM, and a nonvolatile memory such as a flash memory and works to control the operations of the pre-stroke control valve 3C, the pressure-reducing valve 5, and the fuel injectors 6. A discharged pressure calculation/control program, as will be described later in detail, is stored in the ROM (i.e., the nonvolatile memory).

2. Control Operation of Fuel Injection System (ECU)

2.1. Pressure Control

The ECU 7 samples parameters, such as the speed of the engine 8 and the position of the accelerator pedal, which represent the operating conditions of the engine 8, and looks up a control map, as stored in the ROM, to determine the time (i.e., the injection timing) when each of the fuel injectors 6 is to be opened or closed and a target pressure Tp in the common rail 4. The ECU 7 then controls the operations of the pre-stroke control valve 3C and the pressure-reducing valve 5 to bring the pressure in the common rail 4 into agreement with the target pressure Tp.

Specifically, the ECU 7 calculates the flow rate (which will also be referred to as a required flow rate Qn below) at which the fuel is required to be supplied to the common rail 4 in each fuel feeding cycle so as to bring the pressure in the common rail 4 into agreement with the target pressure Tp and measures the flow rate (which will also be referred to as an actual flow rate Qr below) at which the fuel has actually been fed from the high-pressure pump 3 to the common rail 4.

The ECU 7 then calculates a flow rate of fuel (which will also be referred to as an F/B flow rate Qf below) required to bring the pressure in the common rail 4 into agreement with the target pressure Tp, in other words, bring the actual flow rate Qr into coincidence with the required flow rate Qn based on a difference between the required flow rate Qn and the actual flow rate Qr. The ECU 7 controls the operation of the high-pressure pump 3 to discharge the fuel with a flow rate that is the sum of the required flow rate Qn and the F/B flow rate Qf.

Specifically, when the required flow rate Qn is greater than or equal to zero (0), the ECU 7 controls the operation of the pre-stroke control valve 3C to output the fuel from the high-pressure pump 3 at a flow rate that is the sum of the required flow rate Qn and the F/B flow rate Qf. Alternatively, when the required flow rate Qn is lower than zero, the ECU 7 keeps the pre-stroke control valve 3C opened to discharge no fuel from the high-pressure pump 3 and opens the pressure-reducing valve 5.

The ECU 7 works as a PID (Proportional-Integral-Derivative) controller to control the operations of the high-pressure pump 3 (i.e., the pre-stroke control valve 3C) and the pressure-reducing valve 5. The ECU 7 determines gains in the PID algorithm used to calculate the F/B flow rate Qf for the control of the high-pressure pump 3 (i.e., the pre-stroke control valve 3C) and gains used to calculate the F/B flow rate Qf for the control of the pressure-reducing valve 5 independently from each other.

The plunger 3A of the high-pressure pump 3, as described above, reciprocates synchronously with the speed of the engine 8, so that it moves up and down synchronously with reciprocating motion of pistons of the engine 8. The ECU 7, therefore, starts to calculate the required flow rate Qn and the actual flow rate Qr to control the operations of the high-pressure pump 3 and the pressure-reducing valve 5 each time the plunger 3A reaches the top dead center.

Specifically, the ECU 7 completes the calculation of the required flow rate Qn and the actual flow rate Qr and outputs a control signal (will also be referred to as a command signal below) to the high-pressure pump 3 (i.e., the pre-stroke control valve 3C) or the pressure-reducing valve 5 before the high-pressure pump 3 enters the prestroke cycle, that is, during the suction cycle of the high-pressure pump 3. In other words, each time the plunger 3A makes a round-trip, the ECU 7 makes the calculation of the required flow rate Qn and the actual flow rate Qr and outputs the control signal to operate the high-pressure pump 3 (i.e., the pre-stroke control valve 3C) or the pressure-reducing valve 5.

The required flow rate Qn and the actual flow rate Qr are expressed by the volumetric flow rate, not the mass flow rate and will change with a change in either of the temperature or pressure of the fuel. The required flow rate Qn and the actual flow rate Qr, as will be referred to below, are defined by flow rates of fuel in a reference condition, for example, where the temperature of the fuel 40° C., and the pressure of the fuel is 1 atmosphere.

2.2. Calculation of Required Flow Rate Qn

The ECU 7 calculates the required flow rate Qn based on the quantity of fuel which is to be injected by the fuel injector 6 in this injection cycle, the quantity of fuel which is to drain from the fuel injector 6 in this injection cycle, and a pressure difference ΔP between the target pressure Tp and the pressure in the common rail 4, as measured by the pressure sensor 10.

This injection cycle, as described above, is an interval between when the ECU 7 has started to calculate the required flow rate Qn, that is, the plunger 3A has reached the top dead center (which will also be referred to as a calculation start time below) and when the ECU 7 will subsequently start to calculate the required flow rate Qn. The quantity of fuel to be sprayed from the fuel injector 6 is determined in a known manner as a function of the parameters such as the position of the accelerator pedal and the speed of the engine 8 representing the operating conditions of the engine 8.

A target quantity of fuel to be injected into the engine 8 in this injection cycle, as commanded by the control signal from the ECU 7, is substantially identical with the quantity of fuel the fuel injector 6 is required to spray in this injection cycle. However, when the target quantity of fuel is smaller than a predetermined minimum quantity, the ECU 7 instructs the fuel injector 6 to spray the minimum quantity of fuel in this injection cycle.

The quantity of fuel expected to drain from the fuel injector 6 in this injection cycle is calculated by look-up using a map, as stored in the ROM, which represents the drained quantity of fuel as a function of parameters such as the injection duration (i.e., the length of time the fuel injector 6 is kept opened), and the temperature and pressure of the fuel.

The target pressure Tp is determined at the calculation start time. The pressure difference ΔP is given by a difference between the target pressure Tp and the pressure in the common rail 4, as measured by the pressure sensor 10 at the calculation start time.

When the calculated required flow rate Qn is greater than a maximum possible flow rate that is the maximum capacity of the high-pressure pump 3, the ECU 7 determines the maximum possible flow rate as the required flow rate Qn. Alternatively, when the calculated required flow rate Qn is lower than a minimum possible flow rate that is the minimum capacity of the high-pressure pump 3, the ECU 7 determines the minimum possible flow rate as the required flow rate Qn.

The maximum flow rate and the minimum flow rate at which the high-pressure pump 3 is permitted to discharge the fuel depend upon the dimension (i.e., size) of the pressure chamber 3B, the quantity of fuel leaking from the pressure chamber 3B, and the dead volume of the pressure chamber 3B (i.e., the volume of fuel inevitably remaining in the pressure chamber 3B). The leaking quantity of fuel and the dead volume usually change with a change in temperature or pressure of the fuel.

2.3. Calculation of Actual Flow Rate Qr

When the fuel is fed to the common rail 4, it will result in a rise in pressure of the fuel in the common rail 4. Conversely, when the fuel is discharged from the common rail 4, it will result in a drop in pressure of the fuel in the common rail 4. The ECU 7, therefore, calculates the actual flow rate Qr based on a change in pressure at which the fuel has been discharged from the high-pressure pump 3 for a given time interval and the quantity of fuel which has been sprayed from the fuel injector 6 for that time interval.

The above time interval, as referred to herein, is between the present calculation start time and the previous calculation start time, in other words, between when the plunger 3A has most recently reached the top dead center and when the plunger 3A reached the top dead center one stroke earlier. This time interval will also be referred to as a last calculation-to-calculation interval below.

Basically, the ECU 7 determines the sum of the quantity of fuel (which will also be referred to as a target injection quantity or a commanded injection quantity below) the fuel injector 6 was instructed by the control signal outputted from the ECU 7 to spray in the last calculation-to-calculation interval and the quantity of fuel draining from the fuel injector 6 in the last calculation-to-calculation interval as the quantity of fuel which has been supplied to and sprayed from the fuel injector 6.

However, when the target injection quantity is smaller than a predetermined minimum injection quantity, the ECU 7 determines the sum of the minimum injection quantity and the quantity of fuel draining from the fuel injector 6 in the previous injection cycle as the quantity of fuel which has been supplied to and sprayed from the fuel injector 6 in the previous injection cycle. The quantity of fuel draining from the fuel injector 6 usually changes with a change in injection duration (i.e., the length of time the fuel injection is kept opened), or the temperature or pressure of fuel.

The pressure sensor 10 is, as described above, located in the common rail 4 closer to the fuel injectors 6 than to the outlet of the high-pressure pump 3. There is, therefore, a high probability that the output of the pressure sensor 10 is not identical with the pressure of fuel actually discharged from the high-pressure pump 3 due to the pressure propagation, as discussed in the introductory part of this application.

The calculation of the actual flow rate Qr using a change in pressure of fuel, as measured directly by the pressure sensor 10, may, therefore, result in an error thereof. In order to alleviate this problem, the fuel injection system 1 of this embodiment is designed to perform a discharge pressure calculation task to calculate a pump discharge pressure that is the pressure of fuel at the outlet of the high-pressure pump 3 in view of the pressure propagation time at the calculation start time and determine the actual flow rate Qr using the pump discharge pressure.

3. Discharge Pressure Calculation Task 3.1. Outline of Discharge Pressure Calculation The discharge pressure calculation task is executed by the ECU 7 when it is required to calculate the actual flow rate Qr. The program of such a task is stored in the ROM of the ECU 7.

When a given time is reached before the discharge pressure calculation task starts to be executed, e.g., the cam angle of the engine 8 reaches 30° (degrees) within the last calculation-to-calculation interval, the ECU 7 samples the output of the pressure sensor 10 and stores it in the RAM as a measured pressure Psens.

The ECU 7 adds the time T1 (see FIG. 3) elapsed between the start of sampling the output of the pressure sensor 10 to determine pressure Psens and the calculation start time (i.e., the time the pump discharge pressure starts to be calculated) to the time T2 required for the pressure to transmit from the outlet of the high-pressure pump 3 to the pressure sensor 10 to determine a pressure change compensating time Tp.

Subsequently, the ECU 7 calculates a quantity change ΔQ that is a change in quantity of fuel staying in the common rail 4 in the pressure change compensating time Tp and converts it into a pressure change ΔP. The ECU 7 calculates a sum of the pressure change ΔP and the measured pressure Psens to determine a pump discharge pressure Ptop of the high-pressure pump 3.

Figure 3:
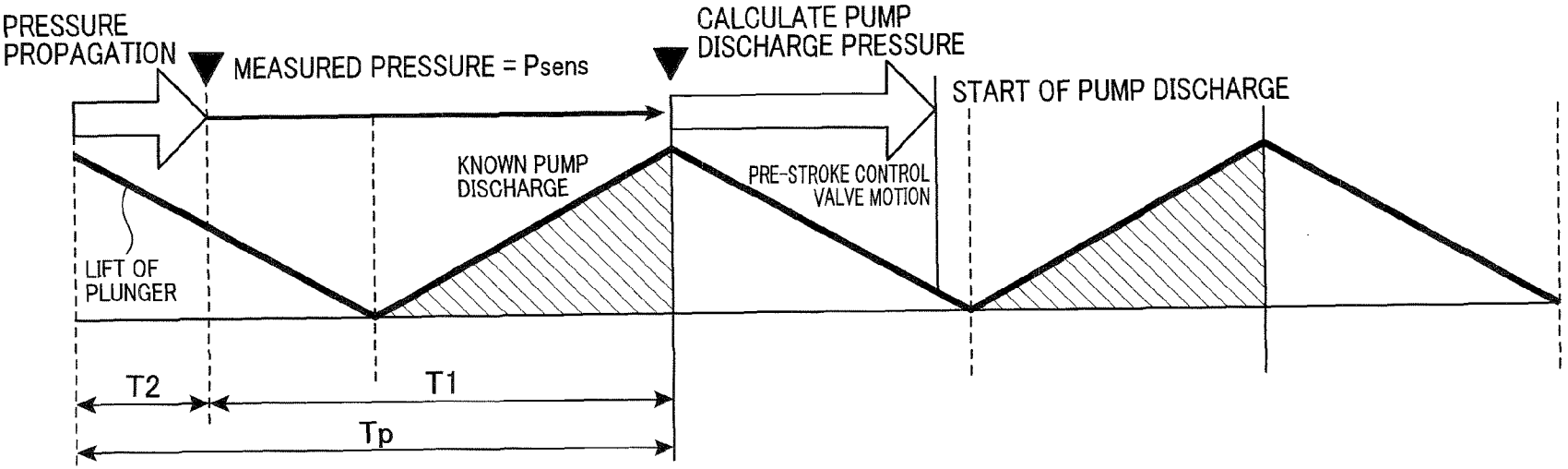
FIG. 3 is a time chart which demonstrates the time when a pump discharge pressure starts to be calculated.

The measured pressure Psens is, as can be seen from FIG. 3, the pressure of fuel sampled the time T1 before the calculation start time, that is, the ECU 7 calculates the pump discharge pressure and also determines the actual flow rate Qr, but the pressure of fuel (which will also be referred to as a propagation time-ago discharge pressure Pt below) discharged from the high-pressure pump 3 the pressure change compensating time Tp (i.e., time T1 plus time T2) before the calculation start time because it takes the time T2 for the pressure to propagate from the outlet of the high-pressure pump 3 to the pressure sensor 10.

Within the pressure change compensating time Tp, the fuel is fed from the high-pressure pump 3 to the common rail 4 and also discharged from the common rail 4 through the fuel injectors 6 or the pressure-reducing valve 5. Consequently, when the quantity of fuel in the common rail 4 has changed by the quantity change ΔQ, the pressure at which the fuel is discharged from the high-pressure pump 3 must have changed from the propagation time-ago discharge pressure Pt by the pressure change ΔP which corresponds to the quantity change ΔQ.

The ECU 7, therefore, adds the measured pressure Psens the propagation time-ago discharge pressure Pt) to the pressure change ΔP that is a change in pressure of fuel into which the quantity change ΔQ of fuel staying in the common rail 4 within the pressure change compensating time Tp is converted to derive the pump discharge pressure Ptop.

Note that when the quantity change ΔQ has a positive value, the pressure change ΔP has a positive value, while when the quantity change ΔQ has a negative value, the pressure change ΔP has a negative value, and when the quantity change ΔQ is zero, the pressure change ΔP is zero.

3.2. Details of Discharge Pressure Calculation

Figure 4:
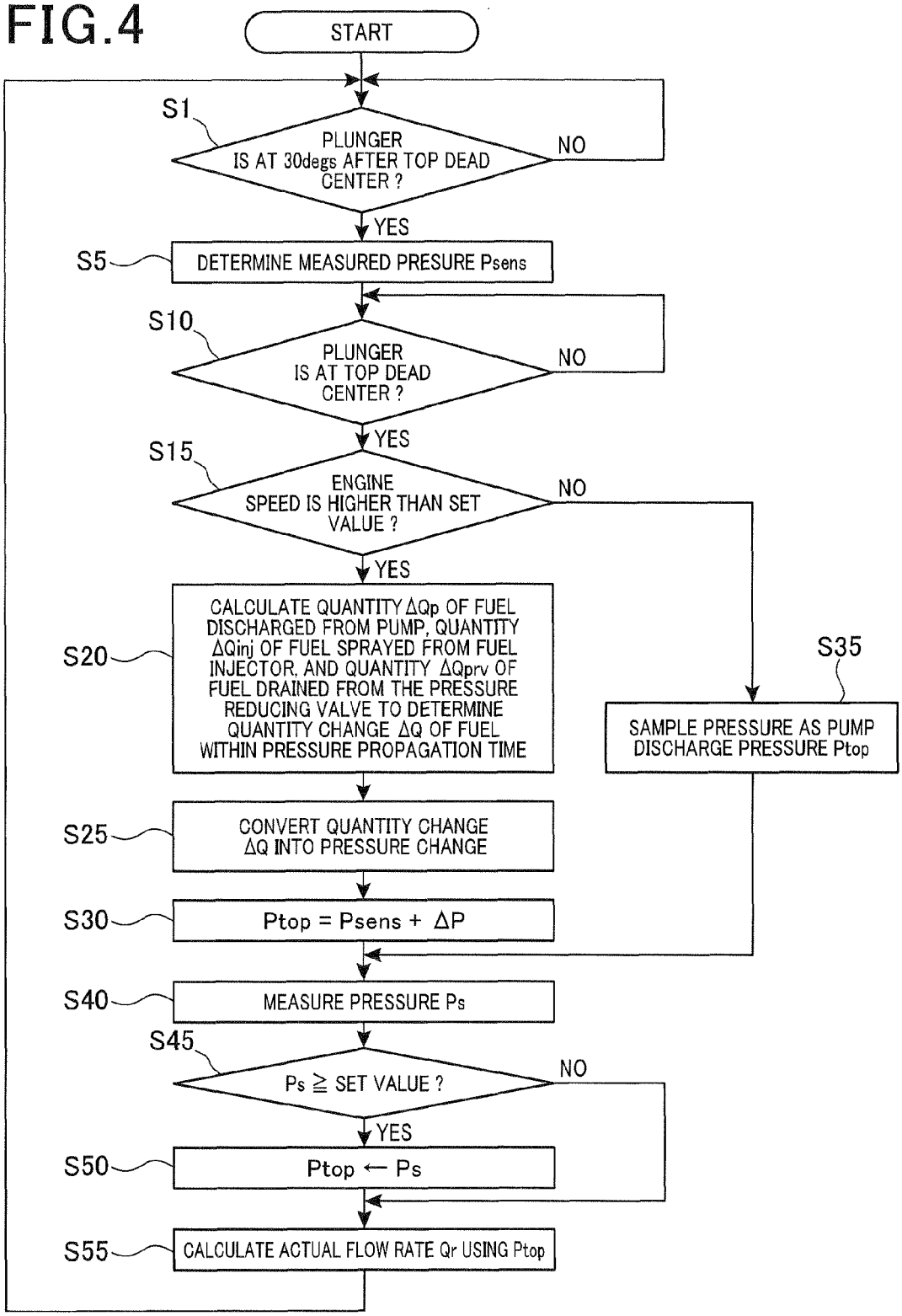
FIG. 4 is a flowchart of a pump discharge calculation program to be executed by the electronic control unit of FIG. 1(*b*).

FIG. 4 is a flowchart of a sequence of logical steps or program to be executed by the ECU 7 to calculate the pump discharge pressure. The program is initiated upon turning on of a start switch such as an ignition switch of the automotive vehicle and stopped upon turning off of the start switch.

After entering the program, the routine proceeds to step S1 wherein it is determined whether the plunger 3A is at a given angular position (e.g., 30°) after the top dead center or not based on the output from the engine speed sensor 13. If a NO answer is obtained meaning that the plunger 3A is not at the given angular position, then the routine repeats step S1.

Alternatively, if a YES answer is obtained in step S1, then the routine proceeds to step S5 wherein the output of the pressure sensor 10 is sampled and stored in the RAM as the measured pressure Psens. The routine proceeds to step S10 wherein it is determined whether the plunger 3A is at the top dead center or not. If a NO answer is obtained, then the routine repeats step S10.

Alternatively, if a YES answer is obtained, then the routine proceeds to step S15 wherein the speed of the engine 8 is greater than a given value or not. If a YES answer is obtained, then the routine proceeds to step S20 wherein the quantity change ΔQ that is a change in quantity of fuel staying in the common rail 4 is determined.

Specifically, the ECU 7 calculates a theoretical quantity ΔQp of fuel discharged from the high-pressure pump 3 within the pressure change compensating time Tp, a quantity ΔQinj of fuel sprayed from the fuel injectors 6 within the pressure change compensating time Tp, and a quantity ΔQprv drained from the pressure reducing valve 5 within the pressure change compensating time Tp and then determines the quantity change ΔQ according to a relation of $\Delta Q=\Delta Qp-\Delta Qinj-\Delta Qprv$.

The theoretical quantity ΔQp of fuel discharged from the high-pressure pump 3 within the pressure change compensating time Tp is calculated as a function of volume of the pressure chamber 3B (which will also be referred to as a high-pressure chamber volume V below) when the plunger 3A is at the top dead center with the pre-stroke control valve 3C closed. The quantity ΔQinj of fuel sprayed from the fuel injectors 6 within the pressure change compensating time Tp is determined based on a period of time for which the fuel has been sprayed from the fuel injectors 6 and the level of pressure in the common rail 4 at that time. The quantity ΔQprv drained from the pressure reducing valve 5 within the pressure change compensating time Tp is determined based on a period of time for which the fuel has been drained from the pressure reducing valve 5 and the level of pressure in the common rail 4 at that time.

After the quantity change ΔQ is derived in step S20, the routine proceeds to step S25 wherein the quantity change ΔQ is converted into the pressure change ΔP by dividing the product of the quantity change ΔQ and a bulk modulus K of the fuel by the high-pressure chamber volume V (i.e., $\Delta P=\Delta Q\cdot K/V$). The routine then proceeds to step S30 wherein the sum of the measure pressure Psens and the pressure change ΔP is defined as the pump discharge pressure Ptop.

If a NO answer is obtained in step S 15 meaning that the speed of the engine 8 is smaller than the given value, then the routine proceeds to step S35 wherein the output of the pressure sensor 10 is determined as the pump discharge pressure Ptop.

After the pump discharge pressure Ptop is derived in step S30 or S35, the routine proceeds to step S40 wherein the output of the pressure sensor 10 is sampled as a measured pressure Ps. The routine proceeds to step S45 wherein it is determined whether the measured pressure Ps is greater than or equal to a given level or not. If a YES answer is obtained, then the routine proceeds to step S50 wherein the pump discharge pressure Ptop is determined again by the measured pressure Ps, as derived in step S40.

Alternatively, if a NO answer is obtained in step S45 meaning that the measured pressure Ps is lower than the given level, the pump discharge pressure Ptop is not reset. Specifically, the pressure, as derived in step S30 or S35, is used in step S55 as the pump discharged pressure Ptop in calculating the actual flow rate Qr. The high-pressure pump 3 (i.e., the pre-stroke control valve 3C) and the pressure reducing valve 5 are then controlled in operation. The routine then returns back to step S1.

If the pump discharge pressure Ptop is given by the measured pressure Ps in step S50, it is used in steps S55 to calculate the actual flow rate Qr. The high-pressure pump 3 (i.e., the pre-stroke control valve 3C) and the pressure reducing valve 5 are then controlled in operation. The routine then returns back to step S1.

3. Feature of Fuel Injection System

The fuel injection system 1 works to correct the output of the pressure sensor 10 (i.e., the measured pressure Psens) using the pressure change ΔP which corresponds to the quantity change ΔQ of fuel within the pressure change compensating time Tp to determine the pump discharge pressure Ptop. In other words, the fuel injection system 1 compensates for an error arising from the pressure propagation to determine the pressure at which the fuel is discharged from the high-pressure pump 3 (i.e., the pressure of fuel at the outlet of the high-pressure pump 3) accurately.

The pump discharge pressure may be determined directly and accurately based on the output of the pressure sensor 10, as sampled after a lapse of a period of time required (i.e., the propagation time T2) for the pressure to propagate from the outlet of the high-pressure pump 3 to the pressure sensor 10.

However, when a value, which is derived by dividing the sum t1 of an actuation time of the pre-stroke control valve 3C and a calculation time in which the time when the pre-stroke control valve 3C is to be actuated is calculated by one cycle time t2 (i.e., the time required by the plunger 3A to make a round trip), which will also be referred to as an operating time ratio η, is great, and the ECU 7 starts to control the operation of the pre-stroke control valve 3C after a lapse of the propagation time T2, it may cause the plunger 3A to have already entered the subsequent cycle when the pre-stroke control valve 3C has started to be actuated. In such an event, it is impossible to control the quantity or flow rate of fuel discharged from the high-pressure pump 3 accurately.

Conversely, when the operating time ratio η is small, it means that a ratio of the actuation time of the pre-stroke control valve 3C to the one cycle time t2 is small, thus enabling the ECU 5 to actuate the pre-stroke control valve 3C completely within the one cycle time t2. This permits the quantity or flow rate of fuel discharged from the high-pressure pump 3 to be controlled finely.

Therefore, when the operating time ratio η is greater than a given value, and the ECU 7 performs the above discharge pressure calculation task to determine the pump discharge pressure Ptop, it becomes possible for the ECU 7 to start to control the operation of the pre-stroke control valve 3C to regulate the flow rate of fuel discharged from the high-pressure pump 3 accurately prior to expiry of the propagation time T2.

The discharge pressure of the high-pressure pump 3 and the pressure of fuel sprayed from the fuel injectors 6 may be measured accurately by using two pressure sensors: one installed in the outlet of the high-pressure pump 3 and the other installed near the fuel injectors 6, but it results in an undesirable increase in production cost of the fuel injection system 1.

The discharge pressure calculation task, as described above, serves to determine the discharge pressure of the high-pressure pump 3 accurately without use of the two pressure sensors and does not lead to the increase in production cost of the fuel injection system 1.

The sum t1 of the actuation time of the pre-stroke control valve 3C and the calculation time required to calculate the time the pre-stroke control valve 3C is to be actuated may be handled as a constant time. The time it takes for the plunger 3A to move up and down (i.e., the one cycle time t2) decreases with an increase in speed of the engine 8.

Therefore, when the speed of the engine 8 exceeds a reference value corresponding to the operating time ratio η, the ECU 7 executes the discharge pressure calculation task to determine the pump discharge pressure Ptop. When the speed of the engine 8 is lower than the reference value (see step S15), the ECU 7 determines the measured pressure Psens as the pump discharge pressure Ptop.

When the high-pressure pump 3 or the fuel injectors 6 are operating properly, the output of the pressure sensor 10, will not be excessively large, but when they have failed in operation, it may cause the output of the pressure sensor 10 to have a value exceeding a normal set pressure. In contrast, the fuel injection system 1 is so designed that when the output of the pressure sensor 10 has a value lower than a reference value (see a NO answer in step S45) during execution of the discharge pressure calculation task, the ECU 7 determines the discharge pressure of the high-pressure pump 3 through the discharge pressure calculation task as the pump discharge pressure Ptop and uses it in controlling the operation of the high-pressure pump 3 or the pressure reducing valve 5 to bring the pressure in the common rail 4 into agreement with a target value. Alternatively, when the output of the pressure sensor 10 has a value higher than or equal to the reference value (see a YES answer in step S45), the ECU 7 uses the measured pressure Psens directly as the pump discharge pressure Ptop in controlling the operation of the high-pressure pump 3 or the pressure reducing valve 5, thereby permitting the pressure in the common rail 4 to be decreased quickly into an allowable pressure range. This results in improved reliability in operation of the fuel injection system 1.

The discharge pressure calculation task in FIG. 4 executes step S45 to make a comparison between the pressure Ps, as measured in step S40, and the given level. The time required to complete the operations in steps S1 to S45 is very short. The pressure of fuel derived in step S40 may therefore be considered as being measured upon initiation of the discharge pressure calculation task. Usually, when the pressure of fuel is measured using the pressure sensor 10 while the fuel is being sprayed from the fuel injectors 6 or drained from the pressure reducing valve 5, the measured pressure Psens will be affected thereby, thus resulting in an error in determining the pump discharge pressure Ptop. In order to eliminate such an error, the fuel injection system 1 calculates the pump discharge pressure Ptop so as to compensate for the pressure change ΔP, as derived based on the quantity change ΔQ of fuel staying in the common rail 4 in the pressure change compensating time Tp, that is, the theoretical quantity ΔQp of fuel discharged from the high-pressure pump 3, the quantity ΔQinj of fuel sprayed from the fuel injectors 6, and the quantity ΔQprv drained from the pressure reducing valve 5, thereby ensuring the accuracy in determining the pump discharge pressure Ptop.

In other words, the fuel injection system 1 of this embodiment is so designed as to compensate for a difference in time between when the output of the pressure sensor 10 is sampled and when the fuel is sprayed from the fuel injectors 6 or drained from the pressure reducing valve 5 to calculate the pressure at which the fuel is discharged from the high-pressure pump 3.

Modifications

The fuel injection system 1, as discussed above, is used with the common rail type diesel engine 8, but however, may be designed for normal diesel engines or direct gasoline-injection engines.

The required fuel quantity Qn or the actual flow rate Qr may alternatively be determined in a manner other than as described above.

The high-pressure pump 3 is of a prestroke adjustment type, but however, may be implemented by another type of pump.

When the measured pressure Psens, as derived by the pressure sensor 10 at the calculation start time, is smaller than a set value, the ECU 7 uses the pressure determined through the discharge pressure calculation task as the pump discharge pressure Ptop to control the operation of the high-pressure pump 3 or the pressure reducing valve 5, but however, may omit steps S40 to S50 and use the pump discharge pressure Ptop, as determined through the discharge pressure calculation task, to control the operation of the high-pressure pump 3 or the pressure reducing valve 5 regardless of the measured pressure Psens.

When the operating time ratio η is greater than or equal to a set value, that is, the speed of the engine 8 is greater than or equal to a set value, the ECU 7 determines the pump discharge pressure Ptop through the discharge pressure calculation task to compensate for an error arising from the propagation time of the pressure of fuel, but however, may calculate the pump discharge pressure Ptop regardless of the operating time ratio η.

The sum t1 of the actuation time of the pre-stroke control valve 3C and the calculation time required to calculate the time the pre-stroke control valve 3C is to be actuated may be handled as a constant time. The ECU 7, therefore, evaluates the operating time ratio η only based on the speed of the engine 8, however, it may consider the operating time ratio η as being dependent upon a change in actuation time of the pre-stroke control valve 3C or assume the calculation time required to calculate the time when the pre-stroke control valve 3C is to be actuated as being zero to determine the operating time ratio η.

The fuel injection system 1 may be equipped with a relief valve instead of the pressure reducing valve 5. For example, a relief valve, as specified in Japanese Industrial Standards B 0125, No. 14-1, may be used to relieve an excessive pressure in the common rail 4.

When the plunger 3A of the high-pressure pump 3 reaches 30° after the top dead center, the ECU 7 samples the output of the pressure sensor 10 (i.e., the measured pressure Psens) as the pressure of fuel before the discharge pressure of the high-pressure pump 3 starts to be calculated, however, it may be measured at another time.

The pressure sensor 10 may alternatively be installed in one of the fuel injectors 6, the high-pressure pump 3, or a high-pressure fuel path leading to the fuel injectors 6, the common rail 4 and the high-pressure pump 3.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A fuel injection system which supplies fuel to an internal combustion engine, comprising:

a pump for pressurizing and feeding fuel, as stored in a fuel tank;

an injector for spraying and supplying the fuel existing in a high-pressure fuel path communicating with an outlet of said pump into the internal combustion engine;

pressure detecting means which is disposed in a portion of the high-pressure fuel path which is closer to the injector than to the outlet of the pump and is for detecting pressure of the fuel in the high-pressure fuel path; and discharge pressure calculating means for calculating a discharge pressure of the pump based on the pressure, as detected by the pressure detecting means, wherein the discharge pressure calculating means includes:

propagation time calculating means for adding a time elapsing from detection of a detection pressure, as detected by the pressure detecting means before a start time of calculation of the discharge pressure, to the start time of the calculation to a time required for pressure to propagate from the outlet of the pump to the pressure detecting means to calculate a pressure variation consideration time;

fuel increase/decrease amount calculating means for calculating a change in amount of the fuel existing in the high-pressure fuel path within the pressure variation consideration time;

conversion means for converting the change in amount, as calculated by the fuel increase/decrease amount calculating means, into a change in pressure; and discharge pressure calculating means for calculating the discharge pressure of the pump based on the change in pressure, as converted by said conversion means, and the detection pressure.

2. A fuel injection system as set forth in claim 1, wherein said fuel increase/decrease calculating means includes:

discharge amount calculating means for calculating an amount discharged from the pump within the pressure variation consideration time;

injection quantity calculating means for calculating a quantity of the fuel sprayed from the injector within the pressure variation consideration time; and discharge amount calculating means for calculating an amount of the fuel discharged from the high-pressure fuel path to a low-pressure side within the pressure variation consideration time.

3. A fuel injection system as set forth in claim 1, wherein:

the pump is configured to discharge the fuel intermittently through reciprocating motion of a plunger and has a flow rate control valve which controls a discharged amount in one cycle;

control means is provided for controlling said flow rate control valve based on the discharge pressure of the pump so as to bring a fuel pressure in the high-pressure fuel path into agreement with a target pressure, as determined based on an operating condition of the internal combustion engine; and when a value derived by dividing a time at least including an actuation time of the flow rate control valve by a time required for one cycle is greater than or equal to a given ratio, said discharge pressure calculating means calculates the discharge pressure of the pump based on said the change in pressure and said detection pressure.

4. A fuel injection system as set forth in claim 1, wherein:

control means is provided for controlling the discharged amount of the pump based on the discharge pressure of the pump so as to bring a fuel pressure in the high-pressure fuel path into agreement with a target pressure, as determined based on an operating condition of the internal combustion engine; and when a pressure, as detected by the pressure detecting means at the start time of calculation, is greater than or equal to a given pressure, said control means determining the pressure, as calculated based on said the change in pressure and said detection pressure, as said discharge pressure to control said discharged amount.

* * * * *